United States Patent [19]

Brzytwa

[11] 4,019,568

[45] Apr. 26, 1977

[54] ROTOR CENTERING DEVICE

[75] Inventor: Tadek Brzytwa, Wellsville, N.Y.

[73] Assignee: The Air Preheater Company, Inc., Wellsville, N.Y.

[22] Filed: Jan. 22, 1976

[21] Appl. No.: 651,309

[52] U.S. Cl. ..... 165/8

[51] Int. Cl.[2] ..... F28D 19/04

[58] Field of Search ..... 165/8

[56] References Cited

UNITED STATES PATENTS

| | | | |
|---|---|---|---|
| 3,024,005 | 3/1962 | Doré et al. | 165/8 X |
| 3,209,058 | 9/1965 | Hazzard | 165/8 X |
| 3,476,173 | 11/1969 | Bracken, Jr. et al. | 165/8 X |
| 3,871,442 | 3/1975 | Finnemore | 165/8 |

FOREIGN PATENTS OR APPLICATIONS

| | | | |
|---|---|---|---|
| 2,260,945 | 7/1973 | Germany | 165/8 |

*Primary Examiner*—C. J. Husar
*Assistant Examiner*—Sheldon Richter
*Attorney, Agent, or Firm*—Wayne H. Lang

[57] ABSTRACT

A device used when assembling rotary regenerative heat exchange apparatus having a rotor disposed about a vertical rotor shaft by which the rotor thereof may be quickly aligned vertically over a subjacent support bearing to preclude mis-alignment during operation.

5 Claims, 3 Drawing Figures

ROTOR CENTERING DEVICE

BACKGROUND OF THE INVENTION

The present invention is directed to means that readily places the rotor in axial alignment with a rotor support bearing to preclude any mis-alignment during operation that might lead to loosening, fracture and failure of a connecting arrangement therebetween.

More particularly, the present invention relates to a centering device that attains rapid alignment and insures continuous axial alignment between the rotor and a housing of a support bearing therefor. After alignment of the rotor and the housing for a support bearing has been achieved, a support bearing is readily substituted for the centering device to assure a long period of trouble-free operation under conditions that include substantially perfect alignment.

BRIEF DESCRIPTION OF THE DRAWING

A more complete understanding of my invention may be realized by referring to the following description in addition to the accompanying drawings in which.

DESCRIPTION OF THE PREFERRED EMBODIMENT

Figure 1:
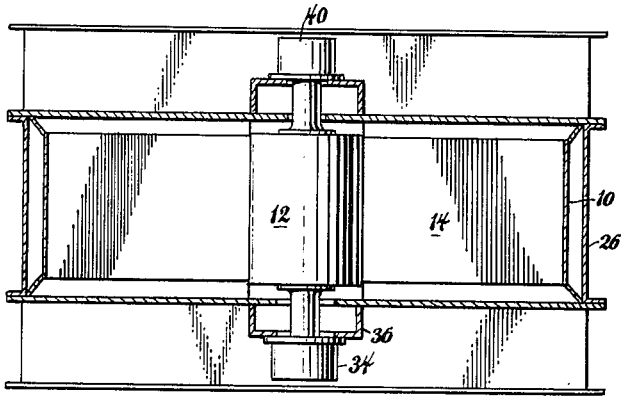
FIG. 1 is a sectional elevation of a rotary regenerative heat exchanger constructed in accordance with the accompanying invention.

In the apparatus shown in the drawing, a rotor shell 10 is spaced concentrically about a central rotor post 12 to provide an annular space therebetween that houses a mass of heat absorbent material 14. The heat absorbent material is contacted alternately by a stream containing a heating fluid and a stream containing a fluid to be heated that traverse the rotor in opposite directions through housing 26 that surrounds the rotor. While the various fluids are traversing the rotor, the rotor is being slowly and continuously rotated about its axis by suitable drive means (not shown) so that the fluids alternately contact spaced parts of the rotor and thus transfer heat from the heating fluid to the fluid to be heated.

The rotor is mounted for continuous rotation about its own vertical axis on a support bearing 32 at one end of the trunnion 38 and a guide bearing 40 at the opposite end of the rotor. The support bearing 32 rests on an annular shoulder 43 that is contained in housing 34 held by bolts 37 to the underside of support beam 36 that extends under the rotor. The annular shoulder 43 includes a central cavity 64 for a radial bearing 41 that is secured to the end of the trunnion to prevent lateral movement thereof, while a removable door 39 permits access to cavity 64.

In the past it has been customary to position the rotor within its surrounding housing and support bearing by simply lowering the rotor and its connecting trunnion into suitable housing structure and then centering it visually in the best manner possible. The rotor was repeatedly raised and lowered, pushed and pulled and then connected to a support bearing when it appeared to be in axial alignment. Any misalignment between the trunnion and the support bearing would result in excessive spacing between adjacent parts, uneven wear, eventual fracture of any coupling means, and finally complete rotor stoppage.

A continuous process of upkeep and repair consequently was required to maintain the rotor properly supported for rotation upon a suitable support bearing. Frequently, even what appeared to be satisfactory was actually imperfect alignment that would require continued re-positioning, re-aligning and re-tightening of any connecting means between the bearing and the support trunnion.

In accordance with this invention the rotor support trunnion 38 is adapted to extend axially down from the rotor post 12 into concentrically spaced relation with support bearing housing 34. The annular surface 43 in housing 34 is adapted to support the thrust bearing 32 on the upper surface thereof and the radial bearing 41 in the inner cavity 64 to preclude lateral movement of trunnion 38. The cavity 64 also serves to receive a temporary centering device that aligns the rotor concentrically within the surrounding rotor housing.

The centering device comprises essentially a central stem 54 having an axial bore 56 extending therethrough to receive a bolt 52 in threaded recess 48 concentrically centered in the end of trunnion 38. The bolt 52 may be manipulated through open door 39 at the bottom of the housing. Upon turning the bolt 52, the boss 44 may be drawn tightly into the threaded recess at the bottom of trunnion 38 to provide complete axial alignment between the trunnion 38 and the stem 54.

Figure 2:
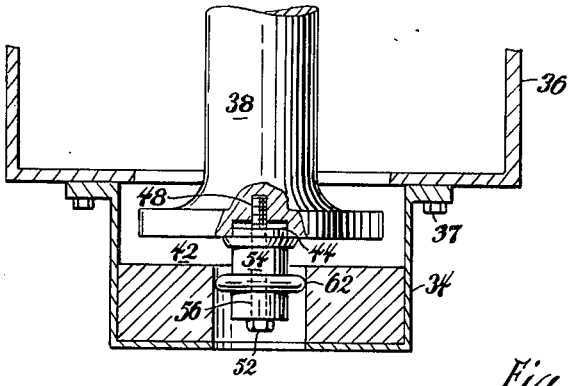
FIG. 2 is an enlarged sectional elevation showing the construction details of a rotor centering device.
Figure 3:
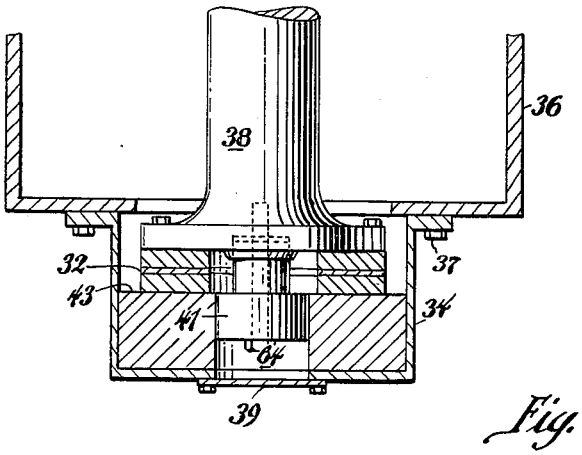
FIG. 3 is an enlarged sectional elevation showing a radial bearing in position replacing the centering device.

The stem 54 is provided with a transverse disc 62 formed integrally therewith and having an extreme outside diameter that is only slightly less than that of cavity 64 thus permitting freedom of rotation therein. The lateral edges of disc 62 are chamfered severly to provide a point contact in the manner shown by FIG. 2 that permits the entire centering device 54 to be tilted within the cylindrical cavity 64 until the bolt 52 may engage the threads of threaded recess 48 and by tightening, may be drawn thereto. After the bolt 52 is tightened and shoulder or boss 44 is drawn into the counterbore, which is aligned with recess 48, the rotor post becomes concentrically aligned with the bearing housing, and it becomes a simple expedient to substitute a radial bearing 41 for the temporary centering device 54.

In assembly, the rotor 10 is simply lowered into its housing 26 in what appears to be an axially aligned relation thereto. The temporary centering device is then inserted in cavity 64 and tilted around until the bolt 52 contacts the threaded recess 48. Upon turning the bolt 52, the boss 44 will be drawn into the counterbore of the trunnion 38, and the centering device 54 will be brought into perfect axial alignment therewith. When axially aligned, the centering device 54 may be removed by removal of bolt 52, an axial thrust bearing 32 centered on surface 43, and the radial bearing 41 may be substituted for the centering device 54.

Various arrangements such as including shims under spaced parts of the rotor may be used to hold the rotor in a fixed position in the rotor housing after a concentric arrangement has been obtained. Inasmuch as numerous arrangements having a similar result may be used, such arrangements are not made a part of this invention. It should be evident therefore that various changes may be made in the specific design shown or the particular sequence of operation without departing from the spirit of the invention. Therefore, all matter contained in the above description or shown in the accompanying drawing shall be interpreted as illustrative and not in a limiting sense.

I claim:

1. Rotary regenerative heat exchange apparatus including a cylindrical rotor housing having end plates at opposite ends thereof with apertures therethrough for a heating fluid and a fluid to be heated, a rotor of heat absorbent material concentrically disposed about a vertical rotor post positioned within the cylindrical rotor housing to receive the heating fluid and the fluid to be heated, a housing for a support bearing subjacent the rotor having an annular shelf with a cylindrical central chamber therein concentric with the rotor, means affixing the housing for the support bearing concentrically to the rotor housing, an annular support bearing lying on said shelf adapted to support the rotor for rotation about its axis, a centering device in the central chamber having a disc with an axially aligned stem attached to the rotor post, said disc having a bearing contact with the arcuate walls of the cylindrical chamber, and a radial guide bearing adapted to replace said centering device having substantially the same diameter as said centering device and adapted to extend concentrically through the cylindrical chamber to the rotor post to position said post concentric with the central chamber and to prevent lateral displacement of the rotor.

2. Apparatus as defined in claim 1 wherein the disc of said centering device has a rounded peripheral surface that provides maximum radius when viewed from a point normal to the central axis of said stem.

3. Apparatus as defined in claim 2 wherein the means aligning the stem of the centering device with the rotor post includes a bore extending axially through the stem of said centering device, a threaded recess at the bottom of the rotor post along the longitudinal axis thereof, and bolt means extending through said bore to the threaded recess in said rotor post to effect axial alignment when the bolt is drawn into said recess.

4. Apparatus as defined in claim 3 wherein the bolt engages the threaded recess at the bottom of the rotor post with a loose fit that permits mis-alignment therebetween.

5. Apparatus as defined in claim 4 including a cylindrical boss on the end of said centering device, and a second recess formed at the end of the rotor post concentrically with said threaded recess whereby the cylindrical boss will be drawn into the second recess when the bolt means is turned into the threaded recess.

* * * * *